US009682423B2

(12) United States Patent
Nakatsuka

(10) Patent No.: US 9,682,423 B2
(45) Date of Patent: Jun. 20, 2017

(54) ELECTRIC DIE CASTING MACHINE

(71) Applicant: Toyo Machinery & Metal Co., Ltd., Akashi-shi, Hyogo (JP)

(72) Inventor: Yoshihisa Nakatsuka, Akashi (JP)

(73) Assignee: Toyo Machinery & Metal Co., Ltd., Akashi-shi (JP)

( * ) Notice: Subject to any disclaimer, the term of this patent is extended or adjusted under 35 U.S.C. 154(b) by 133 days.

(21) Appl. No.: 14/435,003

(22) PCT Filed: Oct. 8, 2013

(86) PCT No.: PCT/JP2013/077330
§ 371 (c)(1),
(2) Date: Apr. 10, 2015

(87) PCT Pub. No.: WO2014/057930
PCT Pub. Date: Apr. 17, 2014

(65) Prior Publication Data

US 2015/0290705 A1 Oct. 15, 2015

(30) Foreign Application Priority Data

Oct. 12, 2012 (JP) ..... 2012-227256

(51) Int. Cl.

| | |
|---|---|
| ***B22D 17/08*** | (2006.01) |
| ***B22D 17/20*** | (2006.01) |
| ***B22D 17/30*** | (2006.01) |
| ***B22D 17/32*** | (2006.01) |
| ***B22D 17/10*** | (2006.01) |

(52) U.S. Cl.
CPC ..... *B22D 17/32* (2013.01); *B22D 17/08* (2013.01); *B22D 17/10* (2013.01); *B22D 17/203* (2013.01); *B22D 17/2015* (2013.01); *B22D 17/30* (2013.01)

(58) Field of Classification Search
CPC ..... B22D 17/08; B22D 17/10; B22D 17/20; B22D 17/2015; B22D 17/203; B22D 17/30; B22D 17/32
USPC ..... 164/312, 313, 314, 315
See application file for complete search history.

(56) References Cited

U.S. PATENT DOCUMENTS

| | | | | |
|---|---|---|---|---|
| 7,726,381 | B2 * | 6/2010 | Taniguchi | B22D 17/32 164/113 |
| 8,807,200 | B2 * | 8/2014 | Nakatsuka | B22D 17/32 164/312 |

FOREIGN PATENT DOCUMENTS

| | | | |
|---|---|---|---|
| JP | 5-185854 | A | 7/1993 |
| JP | 2000-33472 | A | 2/2000 |
| JP | 2001-221304 | A | 8/2001 |

(Continued)

OTHER PUBLICATIONS

International Search Report (PCT/ISA/210) dated Jan. 14, 2014, with English translation (four (4) pages).

*Primary Examiner* — Kevin P Kerns
(74) *Attorney, Agent, or Firm* — Crowell & Moring LLP

(57) ABSTRACT

An electric die casting machine is provided with a screw shaft which is held rotatably, a nut body which is threadably mounted on the screw shaft so as to be able to move forward and backward, an injection plunger which moves forward and backward in conjunction with the forward and backward movement of the nut body, an injection electric servo motor and an intensification electric servo motor which drive and rotate the screw shaft, and a one-way clutch which is disposed between the screw shaft and the intensification electric servo motor.

4 Claims, 7 Drawing Sheets

(56) References Cited

FOREIGN PATENT DOCUMENTS

| | | | |
|---|---|---|---|
| JP | 2009-220486 | A | 10/2009 |
| JP | 2012-187609 | A | 10/2012 |

* cited by examiner

ELECTRIC DIE CASTING MACHINE

TECHNICAL FIELD

The present invention relates to an electric die casting machine. Particularly, it relates to the configuration of an electric injection device which injects/fills a molten metal material into a mold cavity.

BACKGROUND ART

A die casting machine is a molding machine in which an injection plunger provided in an injection device is driven and moved forward every shot to inject/fill a fixed amount of a molten metal material such as an Al alloy or an Mg alloy into a mold cavity to thereby form a product with a required shape. Similarly to an injection molding machine which injects/fills a plastic material into a mold cavity to form a product with a required shape, the die casting machine also injects/fills the molding material into the mold cavity through a low-speed injection step, a high-speed injection step and a intensification step (referred to as "holding pressure step" in the case of the injection molding machine). However, the die casting machine is characterized in that an injection speed in the high-speed injection step is about one digit higher than that in the injection molding machine. Therefore, in the background art, a hydraulic die casting machine which an injection plunger is driven by hydraulic pressure has been the mainstream.

However, the die casting machine provided with the hydraulic injection device can drive the injection plunger at high speed but has various problems that the scale of the plant and equipment is large, the energy efficiency is poor, the inside of the molding plant is contaminated with oil, and the working environment is bad. Therefore, in recent years, electric driven die casting machine without such a drawback have been proposed (e.g. see Patent Literature 1).

As the electric injection device of the die casting machine, the applicant of the present application has already proposed an electric injection device including: a first injection electric motor which is used for low-speed injection and intensification; a second injection electric motor which is used for high-speed injection; a first motive power transmission mechanism which transmits rotary motion of the first injection electric motor to a screw shaft of a ball screw mechanism; a second motive power transmission mechanism which transmits rotary motion of the second injection electric motor to the screw shaft; a first clutch mechanism which is provided in the first motive power transmission mechanism; a second clutch mechanism which is provided in the second motive power transmission mechanism; a nut body which is threadably mounted on the screw shaft; a linear motion body which holds the nut body; an injection plunger which is connected to the linear motion body at its one end; and a controller which controls start-up and stop of the first and second injection electric motors and connection and disconnection of the first and second clutch mechanisms; wherein: the controller stores start timings of a low-speed injection step, a high-speed injection step and an intensification step, starts up the second injection electric motor in a stop state before the start timing of the high-speed injection step, and changes over the second clutch mechanism from a disconnection state to a connection state in the start timing of the high-speed injection step or after the start-up timing of the second injection electric motor before the start timing of the high-speed injection step (see claim 1 of Patent Literature 1). According to the electric injection device stated in Patent Literature 1, the second injection electric motor for high-speed injection is started up in the stop state before the start timing of the high-speed injection step, and the second clutch mechanism for high-speed injection is changed over from the disconnection state to the connection state in or before the start timing of the high-speed injection step. Accordingly, the rotation speed of the second injection electric motor for high-speed injection can be enhanced in advance in the stage in which the second clutch mechanism has to be changed over from the disconnection state to the connection state in order to transmit the drive force of the second injection electric motor for high-speed injection to the screw shaft of the ball screw mechanism. Accordingly, it is possible to increase acceleration of the injection plunger driven through the ball screw mechanism and the linear motion body after the second clutch mechanism is changed over from the disconnection state to the connection state, so that it is possible to use injection motors comparatively low in output to execute a required injection step.

CITATION LIST

Patent Literature

Patent Literature 1: JP-A-2012-187609

SUMMARY OF INVENTION

Technical Problem

However, the electric injection device stated in Patent Literature 1 is provided with the first and second clutch mechanisms. Therefore, there is a problem that the cost of the die casting machine is increased. In addition, the electric injection device stated in Patent Literature 1 has a configuration in which the first and second clutch mechanisms are changed over in accordance with commands issued from the controller. Therefore, there is another problem that, for example, the load on the machine controller performing the overall control of the die casting machine increases. The electric injection device stated in Patent Literature 1 is provided with friction clutches which serve as the clutch mechanisms generating slippage every time when they change over between connection and disconnection. Therefore, there is a further problem that the friction clutches are easily deteriorated over time during use and lots of labor is required for maintenance.

The invention has been accomplished in order to solve such problems inherent in the background-art technique. An object of the invention is to provide an electric die casting machine in which cost can be reduced, predetermined injection operation and intensification operation can be performed, ON/OFF control of a clutch mechanism is unnecessary and maintenance is also easy.

Solution to Problem

In order to solve the foregoing problems, the invention provides an electric die casting machine including: a screw shaft which is held rotatably; a nut body which is threadably mounted on the screw shaft to be able to move forward and backward; an injection plunger which moves forward and backward in conjunction with the forward and backward movement of the nut body; an injection electric servo motor and an intensification electric servo motor which drive and rotate the screw shaft; a one-way clutch which is provided between the screw shaft and the pressure-boosting electric servo motor; and a controller which controls the drive of the injection electric servo motor and the intensification electric servo motor; wherein: the one-way clutch is attached so that, when the screw shaft is driven and rotated in a direction to drive and move forward the injection plunger, the one-way clutch can rotate idly if the rotation speed of the screw shaft driven and rotated by the injection electric servo motor is higher than the rotation speed of the screw shaft driven and rotated by the intensification electric servo motor, and the one-way clutch can transmit the torque of the intensification electric servo motor to the screw shaft if the rotation speed of the screw shaft driven and rotated by the injection electric servo motor is lower than the rotation speed of the screw shaft driven and rotated by the intensification electric servo motor; and the controller controls the drive of the injection electric servo motor in accordance with a predetermined drive condition to execute a low-speed injection step and a high-speed injection step in an injection step, and starts up the intensification electric servo motor during deceleration control of the injection electric servomotor in the high-speed injection step or before the start of the deceleration control to execute an intensification step following the injection step.

According to the configuration, the one-way clutch is provided in a predetermined direction between the screw shaft and the pressure-boosting electric servo motor, and the controller starts up the intensification electric servo motor during the deceleration control of the injection electric servomotor in the high-speed injection step or before the start of the deceleration control. Accordingly, when the rotation speed of the screw shaft driven and rotated by the injection electric servo motor is higher than the rotation speed of the screw shaft driven and rotated by the intensification electric servo motor in the injection step, the one-way clutch rotates idly so that only the drive control of the injection electric servo motor can be performed to execute the low-speed injection step and the high-speed injection step. In the stage in which the rotation speed of the screw shaft driven and rotated by the injection electric servo motor has become lower than the rotation speed of the screw shaft driven and rotated by the intensification electric servo motor, the one-way clutch changes over to the connection state automatically to transmit the torque of the intensification electric servo motor to the screw shaft so that the intensification step can be executed following the injection step. Thus, according to the configuration, it is sufficient as long as one one-way clutch is provided between the intensification electric servo motor and the screw shaft. Thus, the cost of the die casting machine can be reduced. In addition, according to the configuration, in the stage in which the rotation speed of the screw shaft driven and rotated by the injection electric servo motor has become lower than the rotation speed of the screw shaft driven and rotated by the intensification electric servo motor, the one-way clutch changes over to the connection state automatically. Thus, it is not necessary for the controller to perform the changeover control of the clutch device. It is therefore possible to reduce the load on the controller.

In addition, according to the invention, the one-way clutch is provided with an inner ring, an outer ring, and a plurality of cams which are disposed swingably between the inner ring and the outer ring so that when the rotation speed of the inner ring is higher than the rotation speed of the outer ring in the case where the inner ring and the outer ring are rotated in one specific direction, engagement of the cams with the inner ring and the outer ring is released so that the inner ring can rotate idly with respect to the outer ring, and when the rotation speed of the inner ring is lower than the rotation speed of the outer ring, the cams are engaged with the inner ring and the outer ring so that the inner ring and the outer ring can rotate in the specific one direction.

The one-way clutch according to the configuration has a simple structure and hardly generates slippage like a friction clutch when the one-way clutch changes over between connection and disconnection. Accordingly, the one-way clutch hardly deteriorates overtime in spite of long-term use, and maintenance is easy. The durability and reliability of the die casting machine can be enhanced.

In addition, according to the invention, there is provided an electric die casting machine having any of the configurations, wherein: an output shaft of the intensification electric servo motor and the screw shaft are connected to each other through a multi-stage deceleration device.

According to the configuration, the intensification electric servo motor low in output can be used to apply a high intensification to the injection plunger in comparison with that in the case where a one-stage deceleration device is used. Accordingly, the cost of the intensification electric servo motor and hence the cost of the die casting machine can be reduced or the performance of the die casting machine can be enhanced.

Advantageous Effects of Invention

According to the invention, it is sufficient as long as one one-way clutch is provided between the intensification electric servo motor and the screw shaft. Accordingly, the cost of the die casting machine can be reduced in comparison with that in the case where a plurality of clutch mechanisms are provided. In addition, according to the invention, in the stage in which the rotation speed of the screw shaft driven and rotated by the injection electric servo motor has been made lower than the rotation speed of the screw shaft driven and rotated by the intensification electric servomotor during the deceleration control of the injection electric servomotor in the high-speed injection step, the one-way clutch changes over to the connection state automatically to execute the intensification step. Accordingly, it is not necessary for the controller to perform changeover control on the clutch device so that it is possible to reduce the load on the controller.

DESCRIPTION OF EMBODIMENTS

An embodiment of an electric injection device provided in an electric die casting machine according to the invention will be described below with reference to the drawings.

Figure 1:
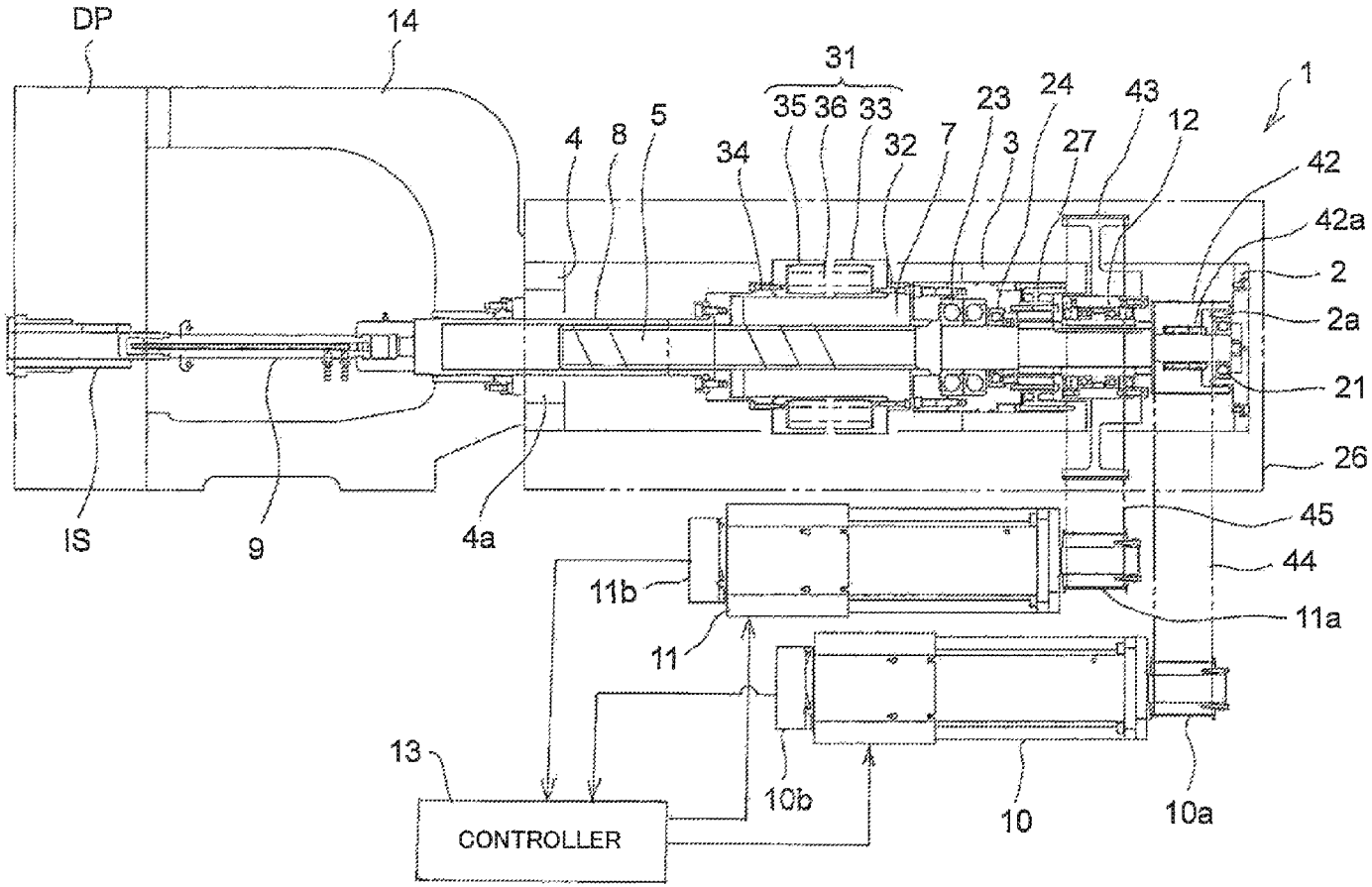
FIG. 1 A main part sectional view of an injection device according to an embodiment when seen from the front side.
Figure 2:
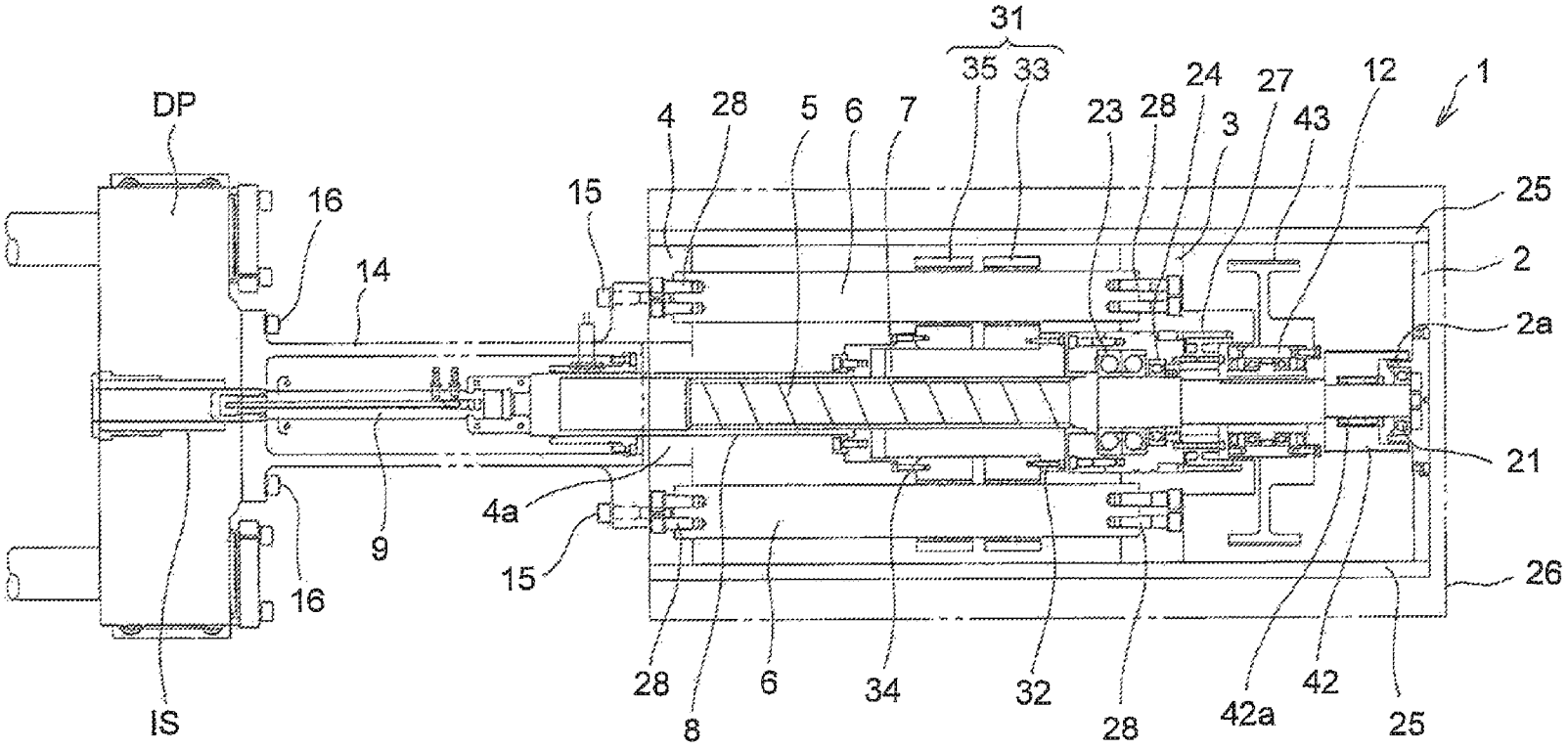
FIG. 2 A main part sectional view of the injection device according to the embodiment when seen from a plane side.

As shown in FIGS. 1 and 2, an electric injection device 1 according to the embodiment is provided with first to third holding plates 2, 3, and 4, a screw shaft 5, guide bars 6, a nut body 7, a cylindrical connection body 8, an injection plunger 9, an injection electric servo motor 10, an intensification electric servomotor 11, a one-way clutch 12, and a controller 13. The first to third holding plates 2, 3 and 4 are disposed to face one another at predetermined intervals. The screw shaft 5 is held rotatably by the first and second holding plates 2 and 3. Each of the guide bars 6 is fixed to the second and third holding plates 3 and 4 at its opposite ends. The nut body 7 is threadably mounted on the screw shaft 5. When the screw shaft 5 is driven and rotated, the nut body 7 is driven and moved forward and backward along the guide bars 6. The connection body 8 is fixed to a front end portion of the nut body 7 at its one end. The injection plunger 9 is fixed to a front end portion of the connection body 8 at its one end. The injection electric servo motor 10 and the intensification electric servo motor 11 drive and rotate the screw shaft 5. The one-way clutch 12 is provided between the screw shaft 5 and the intensification electric servo motor 11. The controller 13 controls the drive of the injection electric servo motor 10 and the intensification electric servo motor 11. Incidentally, the reference numeral 14 in the drawings designates a C-frame making connection between the injection device 1 and a stationary die plate DP of a mold clamping device. As shown in FIG. 2, the C-frame 14 is fixed to the outer surface of the third holding plate 4 and the stationary die plate DP by use of bolts 15 and 16. A front end portion of the injection plunger 9 is disposed inside an injection sleeve IS formed in the stationary die plate DP.

Figure 3:
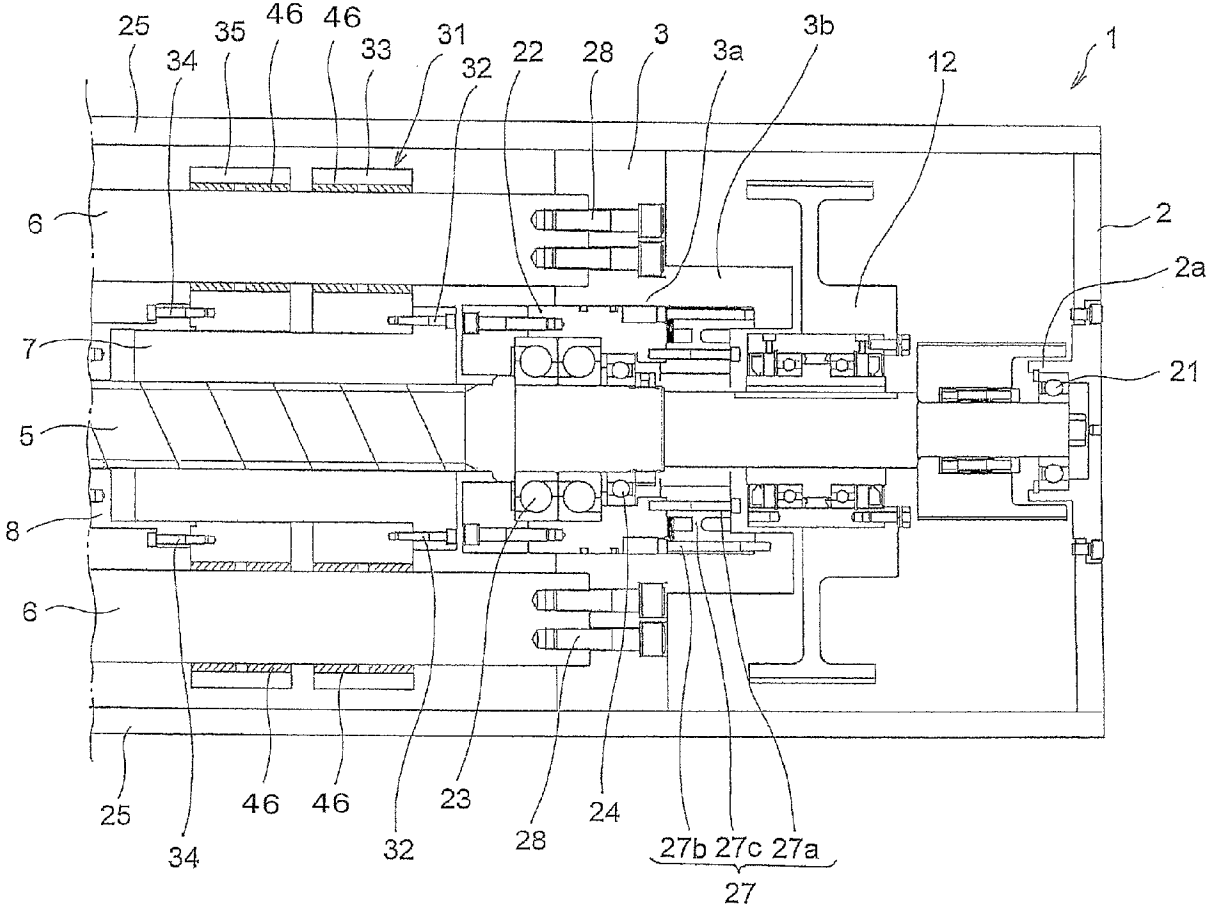
FIG. 3 An enlarged view of a main part of FIG. 2.

As shown in an enlarged view of FIG. 3, a ring-like bearing holding portion 2*a* is provided protrusively in the inner surface of a center portion of the first holding plate 2. One end portion of the screw shaft 5 is held rotatably by the first holding plate 2 through a bearing (bearing) 21. The bearing 21 is inserted between the inner surface of the bearing holding portion 2*a* and the outer surface of the screw shaft 5. In addition, a circular opening portion 3*a* is formed and provided in a center portion of the second holding plate 3. A ring-like stepped boss 3*b* erects from the circumference of the opening portion 3*a*. A bearing holder 22 is inserted into the opening portion 3*a* slidably. An intermediate portion of the screw shaft 5 is held rotatably by the second holding plate 3 through an angular bearing (bearing) 23 and a bearing (bearing) 24. The angular bearing 23 and the bearing 24 are inserted between the inner surface of the bearing holder 22 and the outer surface of the screw shaft 5. Further, a through hole 4*a* for the screw shaft 5 and the connection body 8 is formed and provided in a center portion of the third holding plate 4. As shown in FIGS. 1 and 2, these holding plates 2, 3 and 4 are integrated by a fixation member 25 and fixed on a frame of the not-shown electric die casting machine. It is desirable that the circumferences of these holding plates 2, 3 and 4 and the fixation member 25 are covered with a protective cover 26 in order to protect the safety of a worker etc.

As shown in FIGS. 1 to 3, a load cell unit 27 formed into a ring shape having an inner diameter larger than the outer diameter of the screw shaft 5 is disposed concentrically with the screw shaft 5 and in the inner circumference of the stepped boss 3*b* formed in the second holding plate 3. As shown in the enlarged view of FIG. 3, the load cell unit 27 in this example has an inner ring portion 27*a*, an outer ring portion 27*b*, and an elastic deformation portion 27*c* which is formed between these two portions 27*a* and 27*b*. The inner ring portion 27*a* is fastened to the bearing holder 22 by bolts and the outer ring portion 27*b* is fastened to the stepped boss 3*b* by bolts. A not-shown strain gauge is attached to the elastic deformation portion 27*c* so that strain amounts of the elastic deformation portion 27*c*, i.e. an injection pressure, a surge pressure and an intensification acting on the injection plunger 9 can be detected. Thus, in the electric injection device 1 according to the embodiment, the load cell unit 27 formed into a ring shape is disposed concentrically with the screw shaft 6 and installed between the bearing holder 22 and the stepped boss 3*b*. Accordingly, it is possible to reduce a space set for the load cell unit 27 and it is possible to miniaturize the electric injection device 1 and hence miniaturize the electric die casting machine mounted with the electric injection device 1.

As shown in FIG. 2, each of the guide bars 6 is fastened to the second and third holding plates 3 and 4 at its opposite end portions by bolts 28.

Figure 4:
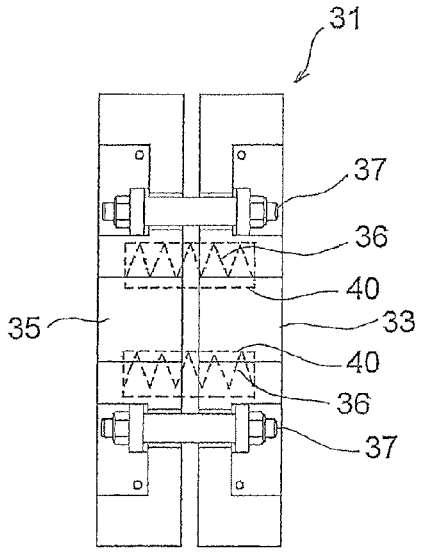
FIG. 4 A front view of a shock absorption device according to the embodiment.
Figure 5:
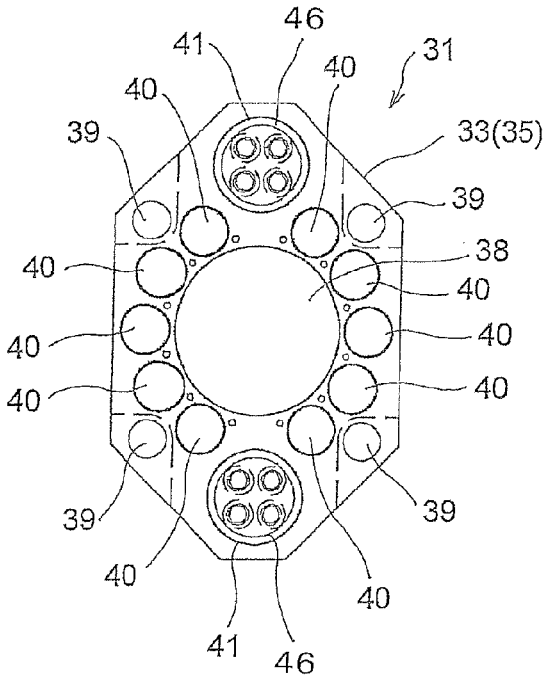
FIG. 5 An interior view of the shock absorption device according to the embodiment.

In addition, as shown in FIGS. 1 to 3, a shock absorption device 31 which serves for suppressing a surge pressure and which is connected to the guide bars 6 at its one end slidably is provided in the outer circumference of the nut body 7. As shown in FIGS. 4 and 5, the shock absorption device 31 in this example is constituted by a first member 33, a second member 35, elastic members 36, and connection bolts 37. The first member 33 is fastened to the nut body 7 by bolts 32. The second member 35 is fastened to the connection body 8 by bolts 34. Each elastic member 36 such as a coil spring is set between the first member 33 and the second member 35. The first member 33 and the second member 35 are connected to each other at a predetermined interval by the connection bolts 37. As shown in FIG. 5, each of the first member 33 and the second member 35 is substantially formed into a hexagon whose inner surface shape is long sideways. A nut body through-hole 38 is formed and provided in each of center portions of the first member 33 and the second member 35 so that the nut body 7 can penetrate the nut body through-hole 38. Connection bolt through-holes 39 are formed and provided in predetermined positions around the nut body through-hole 38 so that the connection bolts 37 can penetrate the connection bolt through-holes 39. In addition, a plurality of (ten in the example of FIG. 5) elastic member receiving holes 40 are formed substantially equally in portions which do not interfere with the connection bolt through-holes 39 but surround the nut body through-hole 38. Further, guide bar through-holes 41 are formed and provided in end portions in a long diameter direction through the nut body through-hole 38 so that the guide bars 6 can penetrate the guide bar through-holes 41. Sliding bearings (metals) 46 are provided inside the guide bar through-holes 41.

The first member 33 is fastened to the nut body 7 by the bolts 32 in the state in which the nut body 7 has penetrated the inside of the nut body through-hole 38 and the guide bars 6 have penetrated the insides of the guide bar through-holes 41. Accordingly, the first member 33 also serves as a guide member by which the nut body 7 is moved along the guide bars 6 when the screw shaft 5 is driven and rotated. On the other hand, the second member 35 is fastened to the connection body 8 by the bolts 34 in the state in which the nut body 7 has penetrated the inside of the nut body through-hole 38 and the guide bars 6 have penetrated the insides of the guide bar through-holes 41. Accordingly, the second member 35 also serves as a motive power transmission mechanism and a guide member by which forward/backward movement of the nut body 7 is transmitted to the injection plunger 9 through the connection body 8 and by which the injection plunger 9 is moved along the guide bars 6.

The elastic members 36 are received between the first member 33 and the second member 35 in the state in which a compressive force as large as or slightly (for example, 1.05 times to 1.1 times) larger than a molten metal pressure occurring during changeover from an injection step to an intensification step has been given to the elastic members 36. In this manner, the elastic members 36 can apply a required injection pressure to molten metal without compression during the injection step. In addition, the first member 33 and the second member 35 are combined at a predetermined interval so that the first member 33 and the second member 35 cannot be closely contacted with each other even when a surge pressure is applied thereto. In this manner, the surge pressure can be absorbed. Incidentally, the compressive force applied to the elastic members 36 can be adjusted suitably when the connection bolts 37 are adjusted.

To a front end portion of the screw shaft 5, not only is a first pulley 42 fixed through a required connector 42*a*, but also a second pulley 43 is attached through the one-way clutch 12. The first pulley 42 serves for transmitting the torque of the injection electric servo motor 10 to the screw shaft 5. A timing belt 44 is laid on the first pulley 42 and a drive side pulley 10*a* fixed to an output shaft of the injection electric motor servo 10. On the other hand, the second pulley 43 serves for transmitting the torque of the intensification electric servo motor 11 to the screw shaft 5. A timing belt 45 is laid on the second pulley 43 and a drive side pulley 11*a* fixed to an output shaft of the intensification electric servo motor 11.

Figure 6:
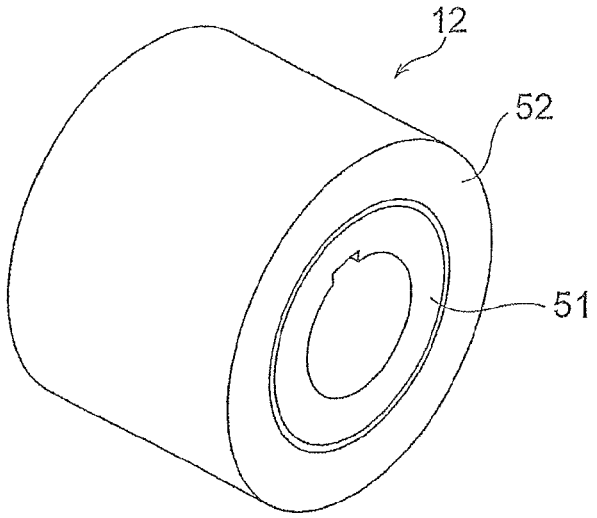
FIG. 6 A perspective view of a one-way clutch according to the embodiment.
Figure 7:
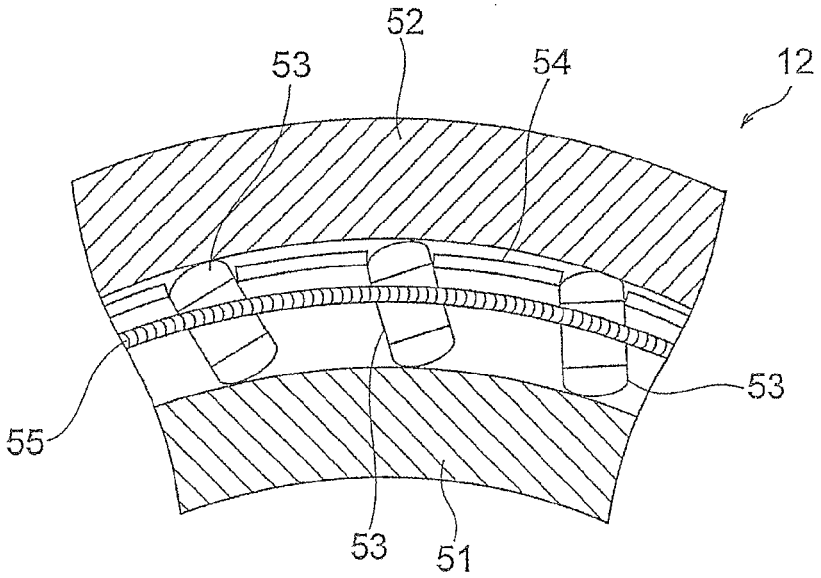
FIG. 7 A main part sectional view schematically showing configuration of the one-way clutch according to the embodiment.

As shown in FIGS. 6 and 7, the one-way clutch 12 is mainly constituted by an inner ring 51, an outer ring 52, a plurality of cams 53, a retainer 54, and a spring member 55. The cams 53 are disposed swingably between the inner ring 51 and the outer ring 52. The retainer 54 retains the cams 53. The spring member 55 urges the cams 53 in one direction. Assume that the inner ring 51 and the outer ring 52 are rotated in one specific direction. In this case, when the rotation speed of the inner ring 51 is faster than the rotation speed of the outer ring 52, the cams 53 disengage from the inner ring 51 and the outer ring 52. As a result, the inner ring 51 rotates idly with respect to the outer ring 52. In addition, when the rotation speed of the inner ring 51 has become lower than the rotation speed of the outer ring 52, the cams 53 engage with the inner ring 51 and the outer ring 52 so that the inner ring 51 and the outer ring 52 can be rotated integrally in the one specific direction. The inner ring 51 is fixed to the outer circumference of the screw shaft 5. The outer ring 52 is fixed to the inner circumference of the second pulley 43.

The controller 13 imports signals from encoders 10*b* and 11*b* provided in the injection electric servo motor 10 and the intensification electric servomotor 11 respectively, a signal from the load cell unit 27, etc., and performs overall drive control of the injection electric servo motor 10 and the intensification electric servo motor 11, such as start-up timings, stop timings, acceleration conditions, deceleration conditions, rotation speeds, and rotation torques, etc. of the injection electric servo motor 10 and the intensification electric servo motor 11. Incidentally, a machine controller performing overall drive control of the die casting machine may be used as the controller 13.

Operation of the electric injection device 1 according to the embodiment configured as described above will be described below with reference to FIG. 8. The following operation is performed based on a command signal outputted from the controller 13.

Figure 8:
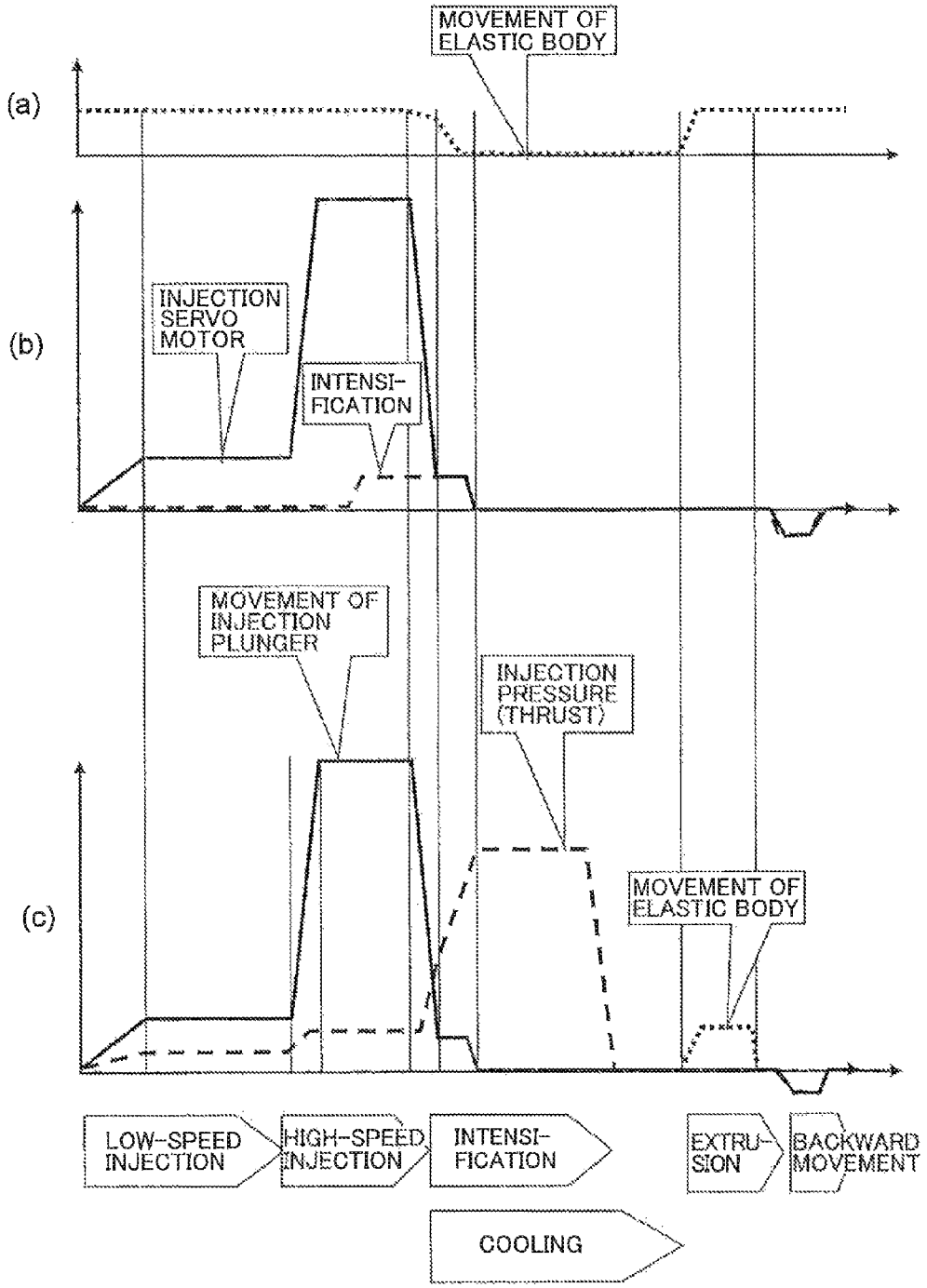
FIG. 8 Timing charts showing operation of a die casting machine according to the embodiment.

As shown in FIG. 8(*b*), when it comes to a start timing of low-speed injection in the state in which the die casting machine is executing continuous automatic operation, the injection electric servo motor 10 is started up in a predetermined rotation direction, and the rotation speed of the injection electric servo motor 10 is controlled as a predetermined rotation speed for low-speed injection. Then, when it comes to a start timing of high-speed injection, the injection electric servo motor 10 is accelerated, and the rotation speed of the injection electric servo motor 10 is controlled as a predetermined rotation speed for high-speed injection. The rotation of the injection electric servomotor 10 is transmitted to the screw shaft 5 through the drive side pulley 10*a*, the timing belt 44 and the first pulley 42 to drive and rotate the screw shaft 5 at the rotation speed for low-speed injection and at the rotation speed for high-speed injection. When the screw shaft 5 is driven and rotated, the nut body 7 threadably mounted on the screw shaft 5 is driven and moved forward. As shown in FIG. 8(*b*), the injection plunger 9 connected to the nut body 7 through the shock absorption device 31 and the connection body 8 is driven and moved forward at a predetermined forward movement speed for low-speed injection and at a predetermined forward movement speed for high-speed injection. In this manner, a fixed amount of molten metal supplied into the injection sleeve IS can be injected into a not-shown mold cavity at the predetermined low injection speed and then injected into the same mold cavity at the predetermined high injection speed.

When the molten metal inside the injection sleeve IS is injected into the mold cavity due to the forward movement of the injection plunger 9, a shocking surge pressure acts on the molten metal inside the mold cavity. When the surge pressure is excessively large, molding defects such as burrs occur in a product easily. The electric injection device 1 according to the embodiment absorbs the surge pressure into the elastic members 36 provided in the shock absorption device 31. That is, the surge pressure having occurred in the high-speed injection step is transmitted to the second member 35 of the shock absorption device 31 through the injection plunger 9 and the connection body 8. Accordingly, the elastic members 36 are compressed between the first member 33 and the second member 35 so that the surge pressure can be absorbed by the elastic deformation of the elastic members 36, as shown in FIG. 8(*a*). According, it is possible to manufacture a good product without applying an excessively large surge pressure to the molten metal inside the mold cavity. In addition, the shock absorption device 31 according to the embodiment is disposed on the outer circumference of the nut body 7. Accordingly, it is possible to shorten the whole length of the electric injection device 1 and hence the whole length of the electric die casting machine in comparison with those in the case where the shock absorption device 31 and the nut body 7 are disposed in series.

When it comes to the end of the injection step, the controller 13 performs deceleration control on the injection electric servo motor 10 and finally stops the rotation of the injection electric servo motor 10, as shown in FIG. 8(*b*). In addition, before starting the deceleration control on the injection electric servo motor 10, the controller 13 starts up the intensification electric servo motor 11, and keeps the rotation speed of the intensification electric servomotor 11 at a predetermined rotation speed. While the rotation speed of the injection electric servo motor 10 is reduced gradually by the deceleration control, the rotation speed of the intensification electric servomotor 11 is increased gradually by the start-up control. Accordingly, the rotation speed of the injection electric servo motor 10 and the rotation speed of the intensification electric servo motor 11 are reversed during the deceleration control on the injection electric servo motor 10.

Accordingly, when the rotation speed of the screw shaft 5 driven and rotated by the injection electric servo motor 10 is higher than the rotation speed of the screw shaft 5 driven and rotated by the intensification electric servomotor 11 even after the pressure-boosting electric servomotor 11 is started up, the one-way clutch 12 rotates idly to prevent the torque of the intensification electric servo motor 11 from being transmitted to the screw shaft 5. Accordingly, the injection electric servo motor 10 is driven and controlled to execute the low-speed injection step and the high-speed injection step in the injection step. When the rotation speed of the screw shaft 5 driven and rotated by the injection electric servomotor 10 is further lowered in this state, the rotation speed of the screw shaft 5 driven and rotated by the injection electric servo motor 10 becomes lower than the rotation speed of the screw shaft 5 driven and rotated by the intensification electric servo motor 11. In this stage, the one-way clutch 12 automatically changes over to a connection state to transmit the torque of the pressure-boosting electric servo motor 11 to the screw shaft 5. The torque is converted into a force of linear motion by the nut body 7 and transmitted to the injection plunger 9 through the shock absorption device 31 and the connection body 8. Due to the motive power supplied thus from the intensification electric servo motor 11, a required intensification pressure is given to the molten metal inside the mold cavity so that an intensification step can be executed following the injection step, as shown in FIG. 8(*c*). In this manner, it is possible to prevent a molding defect such as blow hole of casting.

Incidentally, in the aforementioned drive control of the intensification electric servo motor 11, the intensification electric servo motor 11 is started up before the start of the deceleration control of the injection electric servomotor 10. However, the gist of the invention is not limited thereto but the intensification electric servo motor 11 may be started up simultaneously with or after the start of the deceleration control of the injection electric servo motor 10.

In this manner, in the electric injection device 1 according to the embodiment, the one-way clutch 12 is used as a clutch mechanism. The one-way clutch 12 automatically changes over to a connection state in the stage in which the rotation speed of the screw shaft 5 driven and rotated by the injection electric servo motor 10 has become lower than the rotation speed of the screw shaft 5 driven and rotated by the intensification electric servo motor 11. Accordingly, it is not necessary for the controller 13 to perform the changeover control on the clutch mechanism so that it is possible to reduce the load on the controller 13. In addition, the one-way clutch 12 generates particularly small slippage during its changeover between connection and disconnection to thereby hardly deteriorate over time during use in comparison with a friction clutch. Accordingly, the durability of the electric injection device 1 can be enhanced and maintenance can be made easy in comparison with those in the case where a friction clutch is provided. Further, the electric injection device 1 according to the embodiment is provided with only one one-way clutch 12 between the intensification electric servo motor 11 and the screw shaft 5. Accordingly, it is possible to reduce the cost of the electric injunction device 1 in comparison with the background-art technique provided with a plurality of clutch mechanisms.

The low-speed injection pressure, the high-speed injection pressure, the surge pressure and the intensification pressure acting on the injection plunger 9 respectively in the low-speed injection step, the high-speed injection step and the intensification step are transmitted to the inner ring portion 27*a* of the load cell unit 27 through the injection plunger 9, the connection body 8, the shock absorption device 31, the nut body 7, the screw shaft 5, the angular bearing 23 and the bearing holder 22. Accordingly, a strain corresponding to each of the low-speed injection pressure, the high-speed injection pressure, the surge pressure and the intensification pressure is generated in the elastic deformation portion 27*c* of the load cell unit 27 so that an electric signal corresponding to the strain amount can be outputted from the strain gauge. Accordingly, the electric signal is imported into the controller 13 so that the low-speed injection pressure, the high-speed injection pressure, the surge pressure and the intensification pressure can be monitored. In the injection device according to the embodiment, the load cell unit 27 is disposed on the outer circumference of the screw shaft 5. Accordingly, the whole length of the electric injection device 1 and hence the whole length of the electric die casting machine can be shortened in comparison with those in the case where the load cell unit 27 and the screw shaft 5 are disposed in series.

After the intensification step is completed, a cooling step is completed and a not-shown mold opening/closing electric servo motor is driven to execute a mold opening step. Then, the pressure in an extrusion direction is applied to a biscuit by the injection plunger 9 from the start time of the mold opening step by restoration forces of the elastic members 36 which have been compressed in the intensification step. Accordingly, biscuit extrusion operation can be performed following the mold opening operation. Then, the injection electric servomotor 10 is reversely driven to restore the nut body 7 to its original position. In accordance with this, the connection body 8 and the injection plunger 9 are also restored to their original positions.

Figure 9:
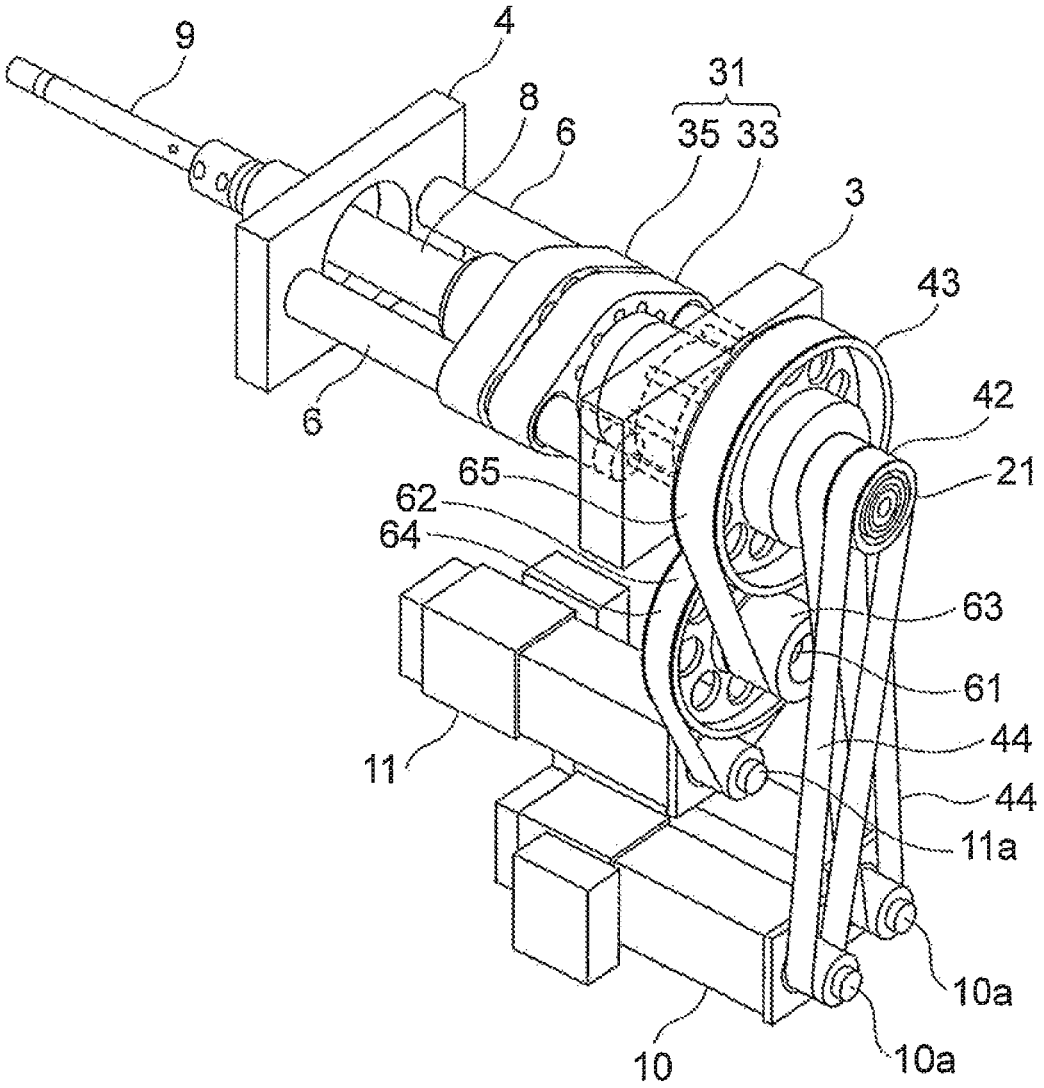
FIG. 9 A perspective view of an injection device according to another embodiment.

Incidentally, the gist of the invention is placed in the point that the one-way clutch 12 is disposed between the screw shaft 5 and the intensification electric servo motor 11. The remaining configuration is not limited to the aforementioned embodiment but may be designed and changed properly. For example, configuration may be made as shown in FIG. 9 in such as a manner that a plurality of (two in the example of FIG. 9) injection electric servo motors 10 are provided and the torques of the respective injection electric servo motors 10 are transmitted to the screw shaft 5 through a plurality of (two in the example of FIG. 9) timing belts 44. In addition, configuration may be made likewise as shown in FIG. 9 in such a manner that the torque of the intensification electric servo motor 11 is transmitted to the screw shaft 5 through a multi-stage (two-stage in the example of FIG. 9) deceleration mechanism. The two-stage deceleration mechanism shown in FIG. 9 includes a drive side pulley 11*a*, a first intermediate pulley 62, a second intermediate pulley 63, a second pulley 43, a first timing belt 64, and a second timing belt 65. The drive side pulley 11*a* is fixed to an output shaft of the intensification electric servo motor 11. The first intermediate pulley 62 and the second intermediate pulley 63 are fixed to an intermediate shaft 61. The second intermediate pulley 63 has a smaller diameter than that of the first intermediate pulley 62. The second pulley 43 is attached to the screw shaft 5 through the one-way clutch 12. The first timing belt 64 is laid on the drive side pulley 11*a* and the first intermediate pulley 62. The second timing belt 65 is laid on the second intermediate pulley 63 and the second pulley 43. According to these modifications, the injection electric servo motors 10 and the intensification electric servo motor 11 which are low in output can be used to generate a high injection pressure and a high intensification pressure. Accordingly, it is possible to obtain an electric die casting machine which is more inexpensive but has higher performance.

REFERENCE SIGNS LIST

1 electric injection device
2, 3, 4 holding plate
5 screw shaft
6 guide bar
7 nut body
8 connection body
9 injection plunger
10 injection electric servo motor
11 intensification electric servo motor
12 one-way clutch
13 controller
21 bearing
22 bearing holder
23 angular bearing
24 bearing
25 fixation member
26 protective cover
27 load cell unit
28 bolt
31 shock absorption device
33 first member
35 second member
36 elastic member
37 connection bolt
38 nut body through-hole
39 connection bolt through-hole
40 elastic member receiving hole
41 guide bar through-hole
42 first pulley
43 second pulley
44, 45 timing belt
51 inner ring
52 outer ring
53 cam
54 retainer
55 spring member

The invention claimed is:

1. An electric die casting machine, comprising:

a screw shaft which is held rotatably; a nut body which is threadably mounted on the screw shaft to be able to move forward and backward; an injection plunger which moves forward and backward in conjunction with the forward and backward movement of the nut body; an injection electric servo motor and an intensification electric servo motor which drive and rotate the screw shaft; a one-way clutch which is provided between the screw shaft and the intensification electric servo motor; and a controller which controls the injection electric servo motor and the intensification electric servo motor; wherein:

the one-way clutch is attached so that, when the screw shaft is driven and rotated in a direction to drive and move forward the injection plunger, the one-way clutch rotates idly if a rotation speed of the screw shaft driven and rotated by the injection electric servo motor is higher than a rotation speed of the screw shaft driven and rotated by the intensification electric servo motor, and the one-way clutch transmits a torque of the intensification electric servo motor to the screw shaft if the rotation speed of the screw shaft driven and rotated by the injection electric servo motor is lower than the rotation speed of the screw shaft driven and rotated by the intensification electric servo motor; and the controller controls the injection electric servo motor in accordance with a predetermined drive condition to execute a low-speed injection step and a high-speed injection step in an injection step, and starts up the intensification electric servo motor during deceleration control of the injection electric servo motor in the high-speed injection step or before the start of the deceleration control to execute an intensification step following the injection step.

2. An electric die casting machine according to claim 1, wherein:

the one-way clutch is provided with an inner ring, an outer ring, and a plurality of cams which are disposed swingably between the inner ring and the outer ring so that when a rotation speed of the inner ring is higher than a rotation speed of the outer ring in the case where the inner ring and the outer ring are rotated in one specific direction, engagement of the cams with the inner ring and the outer ring is released so that the inner ring rotates idly with respect to the outer ring, and when the rotation speed of the inner ring is lower than the rotation speed of the outer ring, the cams are engaged with the inner ring and the outer ring so that the inner ring and the outer ring rotates in the specific one direction.

3. An electric injection device of a die casting machine according to claim 1, wherein:

an output shaft of the intensification electric servo motor and the screw shaft are connected to each other through a multi-stage deceleration device.

4. An electric injection device of a die casting machine according to claim 2, wherein:

an output shaft of the intensification electric servo motor and the screw shaft are connected to each other through a multi-stage deceleration device.

* * * * *